US006277216B1

(12) United States Patent
Leap et al.

(10) Patent No.: US 6,277,216 B1
(45) Date of Patent: Aug. 21, 2001

(54) HEAT-TREATED STEELS WITH OPTIMIZED TOUGHNESS AND METHOD THEREOF

(75) Inventors: Michael J. Leap, Massillon; James C. Wingert, North Canton, both of OH (US)

(73) Assignee: The Timken Company, Canton, OH (US)

( * ) Notice: Subject to any disclaimer, the term of this patent is extended or adjusted under 35 U.S.C. 154(b) by 0 days.

(21) Appl. No.: 09/148,243

(22) Filed: Sep. 4, 1998

Related U.S. Application Data

(60) Provisional application No. 60/058,068, filed on Sep. 5, 1997.

(51) Int. Cl.[7] ..... C22C 38/06; C22C 38/44; C22C 38/00; C21D 6/00

(52) U.S. Cl. ..... 148/335; 148/320; 148/663

(58) Field of Search ..... 148/320, 335, 148/546, 663

(56) References Cited

U.S. PATENT DOCUMENTS

| | | | |
|---|---|---|---|
| 4,170,497 | 10/1979 | Thomas et al. | 148/36 |
| 4,170,499 | 10/1979 | Thomas et al. | 148/143 |
| 5,131,965 | 7/1992 | McVicker | 148/334 |
| 5,409,554 | 4/1995 | Leap | 148/653 |
| 5,458,704 | 10/1995 | Bobbert et al. | 148/547 |

OTHER PUBLICATIONS

Leap, M.J. et al., "Recent Advances in the Technology of Toughening Grain–Refined, High–Strength Steels", SAE Technical Paper Series No. 961749 (Aug. 26–28, 1996).

Leap, M.J. et al., "Application of the AdvanTec[198] Process For Improving the Toughness of Grain–/Refined, High–Strength Steels", 38[th] Mechanical Working & Steel Processing Conference Proceedings. Iron & Steel Society, Inc. (1996).

Leap, M.J. et al., "Development of a Process for Toughening Grain–Refined, High–Strength Steels". ASTM STP 1259, pp. 160–195 (1997).

Sarikaya, M., et al., "Optimization of Fe/Cr/C Base Structural Steels for Improved Strength and Toughness", *Metallurgical Transactions A*. vol. 13A, pp. 2227–2237 (Dec. 1982).

Ramesh, R., et al., "Improvement in Toughness of Fe–Cr–Mn–C Steels by Therman–Mechanical Treatments", *Metallurgical Transactions A*. vol. 21A, pp. 683–695 (Mar. 1990).

Darken, L.S., et al., "Solubility of Gaseous Nitrogen in Gamma Iron and the Effect of Alloying Constituents—Aluminum Nitride Preceipitation", *Transactions AIME*, Journal of Metals, vol. 191, pp. 1174–1179 (Dec. 1951).

*Primary Examiner*—Deborah Yee
(74) *Attorney, Agent, or Firm*—Webb Ziesenheim Logsdon Orkin & Hanson, P.C.

(57) ABSTRACT

Compositions and methods of processing have been developed to optimize the impact toughness of heat-treated, low-alloy steels. The disclosed ranges of steel composition provide a lightly-tempered martensitic microstructure in which grain-refining precipitate forming elements such as titanium and aluminum are essentially absent and the content of iron/alloy carbides retained through the hardening operation is minimized through the application of an appropriate heat treatment wherein austenitizing takes place at temperatures of about 900° C. or above followed by quenching and lightly tempering at about 180° C.

13 Claims, 8 Drawing Sheets

HEAT-TREATED STEELS WITH OPTIMIZED TOUGHNESS AND METHOD THEREOF

CROSS REFERENCE TO RELATED APPLICATION

This application claims the benefit of earlier filed U.S. Provisional Application Ser. No. 60/058,068, filed Sep. 5, 1997, and entitled "Heat-Treated Steels with Optimized Toughness"

BACKGROUND OF THE INVENTION

1. Field of the Invention

The present invention relates to steel compositions and methods of processing that provide lightly-tempered martensitic microstructures with good combinations of strength and toughness.

2. State of the Art

Steels with lightly-tempered martensitic microstructures are finding increased utilization in a variety of highly stressed structural, machine and automotive components. Most work in this field has been generally concerned with the development of toughness through control over the base steel composition (i.e., inherent matrix toughness) or the content and dispersion of non-metallic inclusions (i.e., steel cleanness and inclusion shape control). There more recently has been an increasing awareness of the deleterious effects of smaller second-phase particles such as grain-refining precipitates on the toughness of tempered martensite, and two general approaches have been taken to affect improvements in the toughness of steels containing these precipitates: (i) refinement of the precipitates and (ii) substitution of a less detrimental precipitate species for one which adversely affects toughness.

The first method of improving toughness, which is the basis of a patent by Leap (U.S. Pat. No. 5,409,554, 1995), entails processing to refine grain-refining precipitates in high-strength steels. This method has been shown to provide improvements in toughness over a broad range of strength in a wide variety of base steel compositions containing aluminum, microalloying elements, aluminum in conjunction with any reasonable combination of microalloying elements, and nitrogen in concentrations representative of electric-furnace (EAF) steelmaking practices (M. J. Leap and J. C. Wingert, "Recent Advances in the Technology of Toughening Grain-Refined, High-Strength Steels," SAE International, Paper 961749, 1996 and M. J. Leap and J. C. Wingert, "Application of the AdvanTec Process for Improving the Toughness of Grain-Refined, High-Strength Steels," $38^{th}$ Mechanical Working & Steel Processing Conference Proceedings, Iron & Steel Society, Inc., 1996). This refinement-based mechanism of toughening has also been shown to provide improvements in the low-temperature toughness of high-strength steels (M. J. Leap, J. C. Wingert, and C. A. Mozden, "Development of a Process for Toughening Grain-Refined, High-Strength Steels," Steel Forgings: Second Volume, ASTM STP 1259, American Society for Testing and Materials, 1997).

The second method of affecting toughness in high-strength electric arc furnace or "EAF" steels is based on the precipitation of TiN in preference to AIN in a steel with a nominal composition of 0.3% C., 0.65% Mn, 1.5% Si, 2.0% Cr, 0.4% Mo, 0.1% V, 0.06% Ti, <0.03% Al, and 50–130 ppm N (J. E. McVicker, U.S. Pat. No. 5,131,965, 1992). Although the steels evaluated in this patent exhibit exceptional combinations of hardness and short-rod fracture toughness (i.e., stably-constrained ductile tearing resistance), both the impact toughness and plane-strain fracture toughness of this steel are comparable to other alloy steels containing refined dispersions of grain-refining precipitates. A similar methodology has been taken by Bobbert et al. (U.S. Pat. No. 5,458,704, 1995), where titanium is utilized as a gettering agent for nitrogen in boron-treated steels containing 0.25–0.32% C., 0.1–1.50% Mn, 0.05–0.75% Si, 0.9–2.0% Cr, 0.1–0.70% Mo, 1.2–4.5% Ni, 0.01–0.08% Al, <0.015% P, <0.005% S, and <120 ppm N.

Notwithstanding the degradation in toughness resulting from the purposeful addition of grain-refining elements to high-strength steels, various investigators have noted the potentially deleterious effects of residual alloy carbides (i.e., iron/alloy carbides retained through the hardening heat treatment) on the toughness of tempered martensitic microstructures. For example, Thomas and Rao (U.S. Pat. Nos. 4,170,497 and 4,170,499, 1979), Sarikaya, Steinberg and Thomas (Metallurgical Transactions, vol. 13A, 1982, 2227–2237), and Ramesh, Kim and Thomas (Metallurgical Transactions, vol. 21A, 1990, 683–695) have indicated that the development of good toughness in high-strength steels requires the elimination of coarse alloy carbides from the microstructure, and towards this end, two-stage austenitization treatments have been designed to obviate this problem. General variations on the two-stage heat treatments comprise austenitization at 1100° C. followed by either quenching and reaustenitization at a lower temperature (870° C.) or quenching, tempering at 200° C., and reaustenitization at a lower temperature. As explained in these references, the high-temperature austenitization treatment is utilized to dissolve coarse iron/alloy carbides while the second austenitization treatment is necessary for grain refinement. However, since these references do not contain data for steels subjected to hardening treatments at conventional temperatures (i.e., austenitization in the 800–850° C. range), it is not possible to evaluate the effects of the double-austenitization treatment on toughness via the postulated mechanism. These results are further confounded by the results of Sarikaya, Steinberg and Thomas, where undissolved carbides were not found in a series of alloy steels after the application of either single-austenitization or double-austenitization treatments.

A review of these investigations suggests that while methods have been developed to improve the toughness of high-strength steels containing grain-refining elements, no efforts have specifically focused on the improvements in toughness that can result from the virtual elimination of grain-refining precipitates in lightly-tempered martensitic microstructures. Moreover, relative to the postulated effect of residual iron/alloy carbides on toughness, which has been the basis for the commercially impractical two-stage austenitization treatments, no effort has concentrated on (i) isolating the deleterious effects of residual iron/alloy carbides on toughness and (ii) developing methods to alleviate the degradation in toughness associated with the presence of these particles in lightly-tempered martensite.

SUMMARY OF THE INVENTION

The present invention provides a high-strength steel with optimum toughness. This objective is achieved by minimizing or eliminating grain-refining precipitates and by controlling the content of residual iron carbides and alloy carbides in the microstructure. The minimization or elimination of grain-refining precipitates is accomplished through restrictions on steel composition while the content of residual carbides is minimized by an austenitizing heat treatment at appropriate temperatures.

A complete understanding of the invention will be obtained from the following description when taken in connection with the accompanying drawing figures wherein like reference characters identify like parts throughout.

BRIEF DESCRIPTION OF THE DRAWINGS

FIG. 2(*a*) 0.002% S steel (steel A1) and FIG. 2(*b*) 0.018% S steel (steel A2);

FIG. 4(*a*) 0.001% S steel (steel N1) and FIG. 4(*b*) 0.018% S steel (steel N2);

FIGS. 5(*a*) and 5(*b*) 0.002% S steel (steel A1) and FIGS. 5(*c*) and 5(*d*) 0.018% S steel (steel A2);

FIG. 6(*a*) 0.001% S steel (steel N1) and FIG. 6(*b*) 0.018% S steel (steel N2); FIG. 7(*a*) 0.001–0.002% S steels and FIG. 7(*b*) 0.017–0.018% S steels.

PREFERRED EMBODIMENTS OF THE INVENTION

The present invention is directed to the improvement of toughness in low-alloy, high-strength steels having lightly-tempered martensitic microstructures. The present invention provides improvements in impact toughness resulting from the virtual elimination of grain-refining precipitates in the microstructure and also provides control over the content of iron carbides and alloy carbides hereinafter referred to as "iron/alloy carbides") retained through the hardening heat treatment.

With respect to microalloying elements, the content of grain-refining precipitates is minimized by restricting the contents of elements such as titanium, niobium, and vanadium in the alloy composition. These reductions are accomplished through control over the raw materials or the scrap utilized as melting stock. The same basic approach is utilized for aluminum additions to a steel, but since aluminum is typically employed as both a deoxidation agent and grain-refining element, the allowable aluminum content in a steel is dependent on both the nitrogen content and the heat-treatment temperature for the final product. In effect, these variables are related through the solubility product for AIN in austenite. Based on the solubility product derived by Darken, Smith and Filer (Transactions of the Metallurgical Society of AIME, vol. 3, 1951, 1174–1179), the allowable content of aluminum is calculated as a function of nitrogen content and heat-treatment temperature, $T_a$:

$$\log[\%\,Al_{EFF}] = -\frac{7400}{T_A} + 1.95 - \log[\%\,N_T], \quad \text{and,} \qquad [1]$$

$$[\%\,Al_{EFF}] = [\%\,Al_T] - 1.12[\%\,O_T], \qquad [2]$$

where the subscripts T and EFF refer to the total and effective elemental concentrations, respectively.

Figure 1:
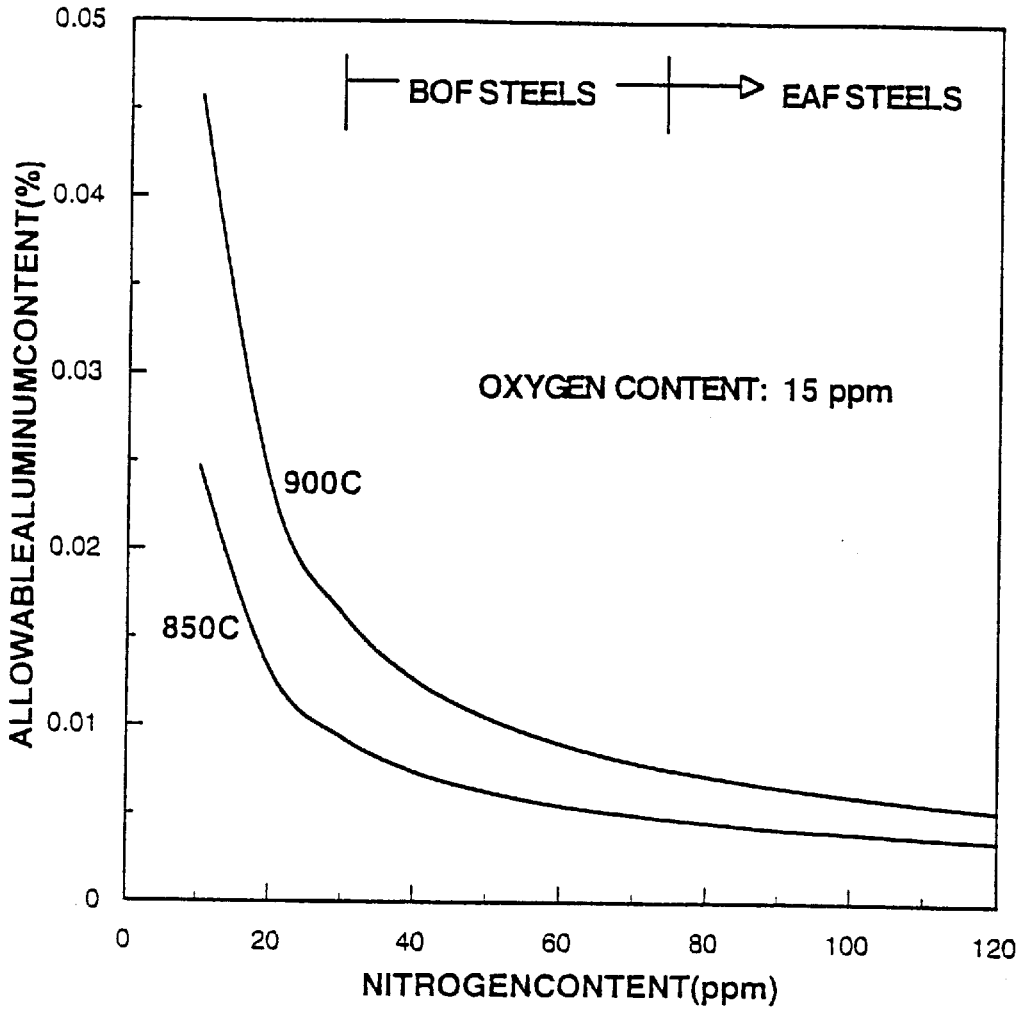
FIG. 1 is a graph showing the allowable aluminum content as a function of nitrogen content for heat-treatment temperatures of 850° C. and 900° C.

The critical or allowable aluminum content is shown as a function of nitrogen content in FIG. 1 for an oxygen content of 15 ppm and austenitization temperatures of 850° C. and 900° C. The allowable aluminum content is greater than 0.02% for vacuum-melted steels ([N]<20 ppm) austenitized at 900° C., and aluminum in concentrations up to 008% can be utilized to deoxidize basic oxygen furnace ("BOF") steels with less than 70 ppm N. However, the content of aluminum must be maintained at residual levels (~0.005%) for air-melt EAF steels with nitrogen contents above ~100 ppm if austenitization is conducted at 900° C. A decrease in austenitization temperature to 850° C. produces a drastic decrease in the allowable aluminum content, and residual levels of aluminum in conjunction with nitrogen contents of less than ~70 ppm would be required to avoid any potential AIN precipitation in austenite. These data illustrate the importance of selecting an appropriate austenitization temperature based on the composition of the steel.

The retention of iron/alloy carbides through the hardening operation is also dependent on steel chemistry and austenitization temperature. Since residual iron/alloy carbides are a non-equilibrium remnant feature in tempered martensitic microstructures, there is no reliable methodology to estimate the volume fraction of these particles after heat treatment. However, the content and thermodynamic stability of these particles would be qualitatively expected to scale in proportion to the carbon content and the concentrations of chromium and/or molybdenum in a steel, respectively. Unlike methods of the prior art, which rely on high-temperature (1100° C.) austenitization to dissolve residual iron/alloy carbides prior to quenching and reaustenitization at a lower temperature, the method of the present invention comprises austenitization at temperatures (approximately 900° C.) that are higher than conventional hardening temperatures (800–850° C.). Rather than attempting to completely eliminate residual iron/alloy carbides, the objective of austenitizing at slightly elevated temperatures is to dissolve a sufficient quantity of these iron/alloy carbide particles to substantially improve the toughness of the resultant, lightly-tempered martensitic microstructure.

There are two practical limitations associated with this latter approach to improving toughness. First, increases in the content and/or stability of iron/alloy carbides require increases in austenitization temperature to effect substantial amounts of particle dissolution, although increases in austenitizing temperature promote grain growth in the absence of both grain-refining precipitates and residual iron/alloy carbides. Thus, the upper bound on austenitization temperature is limited by the maximum allowable grain size, which in most cases is dictated by low-temperature toughness requirements. Second, the method of the present invention is limited to lightly-tempered martensitic microstructures since the comparatively small residual carbides do not adversely affect the toughness of more heavily tempered structures with large temper carbides.

EXAMPLES

Embodiments of the present invention are illustrated through a comparison of the toughness of 0.32% C—Cr—Mn steels containing coarse AIN precipitates, refined AIN precipitates, TiN dispersions consistent with the utilization of titanium as a gettering agent for nitrogen (i.e., a small density of extremely coarse TiN precipitates in conjunction with a much higher density of smaller TiN precipitates), and steels without grain-refining precipitates. In addition, the effects of iron/alloy carbides retained through austenitization are examined in terms of the changes in the toughness of "precipitate-free" steels with austenitization temperature.

The compositions of the steels are listed in Table 1. The aluminum-bearing steels are designated A1, A2; the titanium-bearing steels are designated T1, T2; and the (grain-refining) precipitate-free steels of the invention are designated N1, N2.

TABLE 1

Steel Composition (weight percentages)

| Steel | C | Mn | Si | Cr | Ni | Mo | S | P | Ti | Al | N (ppm) |
|---|---|---|---|---|---|---|---|---|---|---|---|
| A1 | 0.32 | 0.79 | 0.24 | 0.48 | 0.12 | 0.06 | 0.002 | 0.009 | — | 0.026 | 86 |
| A2 | 0.31 | 0.69 | 0.24 | 0.48 | 0.12 | 0.06 | 0.018 | 0.008 | — | 0.024 | 81 |
| T1 | 0.33 | 0.78 | 0.24 | 0.49 | 0.12 | 0.03 | 0.001 | 0.001 | 0.041 | 0.026 | 112 |
| T2 | 0.31 | 0.71 | 0.23 | 0.51 | 0.14 | 0.04 | 0.017 | 0.001 | 0.032 | 0.028 | 94 |
| N1 | 0.33 | 0.80 | 0.24 | 0.50 | 0.11 | 0.05 | 0.001 | 0.008 | — | 0.004 | 22 |
| N2 | 0.30 | 0.70 | 0.24 | 0.50 | 0.12 | 0.05 | 0.018 | 0.006 | — | 0.004 | 16 |

The steels were melted as 45 kg vacuum induction melted ("VIM") heats. The VIM ingots (approximately 140 mm ϕ×300 mm) were reheated in the 1230–1260° C. range for 3–4 hours, upset forged to a 150 mm height, cross forged to a 140 mm width and 70 mm thickness, and air cooled to room temperature. Each ingot was milled to a 64 mm thickness, soaked at ~1260° C. for three hours, hot rolled to 16 mm plate in five passes, and air cooled to room temperature. Billet sections of the aluminum-bearing steels A1and A2 were also oil quenched immediately after hot rolling, subcritically annealed at 700° C. for 1.5 hours, and air cooled to room temperature. The air cooled plates are hereafter referred to as the conventionally-processed steels, whereas the direct-quenched and subcritically annealed steels will be referred to as the pretreated/annealed material condition. This latter method of processing has been shown to provide improvements in toughness via the refinement of grain-refining precipitates (M. J. Leap, U.S. Pat. No. 5,409,554).

Test specimen blanks were extracted from the mid-plane of the hot-rolled plates in the longitudinal orientation. The blanks were austenitized at temperatures in the 800–900° C. range for times between 30 minutes and one hour, quenched to room temperature, and tempered at 180° C. for one hour. The potential effects of austenite grain size as a factor influencing toughness were minimized by determining heat-treatment parameters that provide fine-grained austenite microstructures for the different steels. In addition, specimens of the aluminum-bearing steels A1 and A2 were austenitized at 800° C. for one hour to qualitatively evaluate any interactions between AIN and residual iron/alloy carbides, and specimens of the precipitate-free steels N1 and N2 were austenitized at 1100° C. for one hour to evaluate the toughness of coarse-grained material essentially devoid of both residual iron/alloy carbides and grain-refining precipitates. These heat-treatment parameters are listed in Table 2.

TABLE 2

Heat Treatment Schedules for the Steels

| Steels | Austenitizing Temperature (° C.) | Austenitizing Time (hours) |
|---|---|---|
| A1-A2 | 800 | 1.0 |
| A1-A2 | 900 | 1.0 |
| T1-T2 | 900 | 1.0 |
| N1-N2 | 800 | 0.5 |
| N1-N2 | 900 | 0.5 |
| N1-N2 | 1100 | 1.0 |

The hardness, tensile properties and impact toughness of the steels were evaluated from hardened and tempered specimens. The room-temperature tensile properties of the steels were determined from specimens with a 9 mm diameter and 36 mm gage length in accordance with ASTM E8. Standard Charpy V-notch tests were conducted at temperatures between −60° C. and 170° C. in accordance with ASTM E23.

Steels Containing AIN and TiN

The room-temperature tensile properties of the steels are summarized in Table 3. All specimens were fully hardened and tempered to a hardness of $R_c$50–51. The strength values for the steels generally scale in proportion to carbon content and the longitudinal tensile ductility only exhibits a minor dependence on sulfur content for each steel type. The conventionally-processed specimens of the aluminum-bearing steels A1 and A2 exhibit the lowest levels of tensile reduction in area, although the tensile ductility of the pretreated/annealed specimens is similar to the corresponding values for the titanium-bearing steels T1 and T2.

TABLE 3

Summary of Tensile Test Data for Steels A1-A2 and T1-T2

| Steel | Material Condition[1] | Austenitization Temperature (° C.) | Austenitization Time (hours) | Yield Strength (MPa) | Tensile Strength (MPa) | Elongation in 38 mm (%) | Reduction In Area (%) |
|---|---|---|---|---|---|---|---|
| A1 | CP | 900 | 1.0 | 1450 | 1800 | 6.2 | 22.5 |
| A1 | PA | 900 | 1.0 | 1460 | 1810 | 8.1 | 27.5 |
| A2 | CP | 900 | 1.0 | 1420 | 1790 | 6.3 | 20.2 |
| A2 | PA | 900 | 1.0 | 1460 | 1790 | 7.4 | 25.8 |
| T1 | CP | 900 | 1.0 | 1490 | 1820 | 8.9 | 27.5 |
| T2 | CP | 900 | 1.0 | 1440 | 1780 | 9.1 | 30.1 |

[1]CP = conventional processing; PA = pretreated/annealed.

Figure 2A:
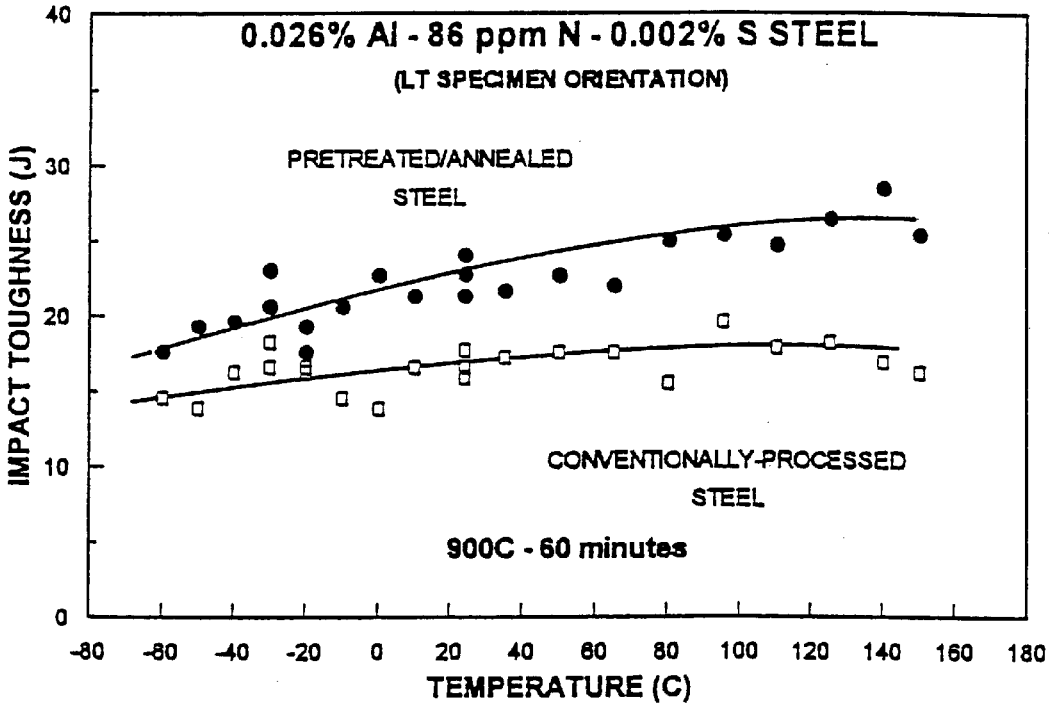
FIGS. 2(*a*) and 2(*b*) are graphs showing the variation in longitudinal impact toughness with test temperature for 0.32% C—Cr—Mn steels containing coarse and refined dispersions of AIN.
Figure 2B:
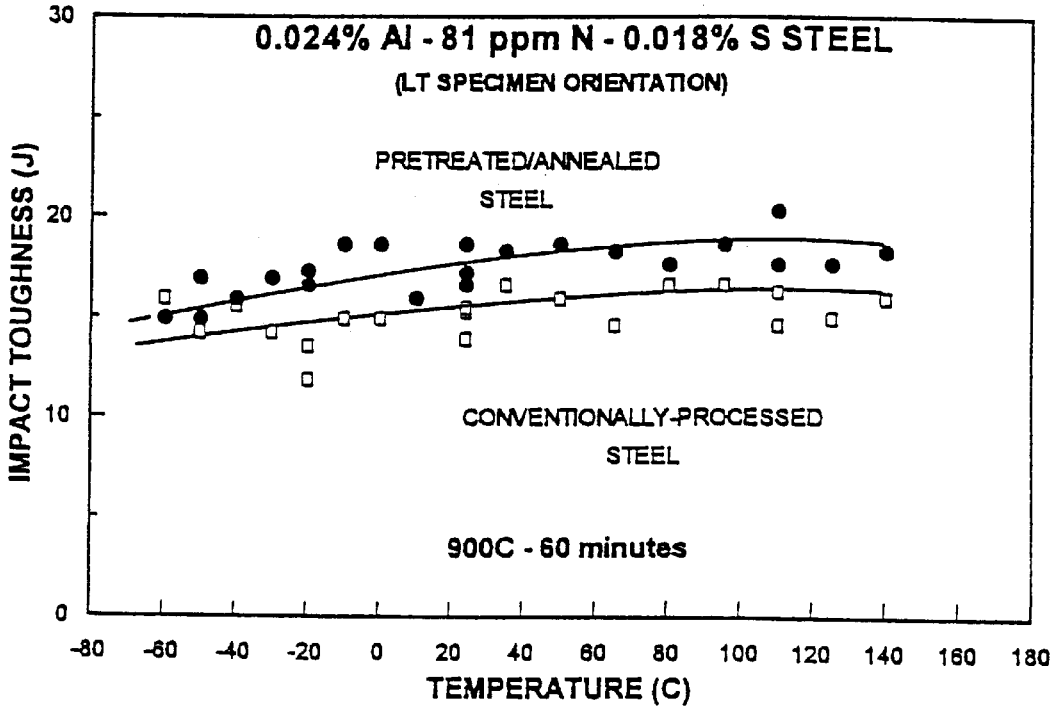

Impact transition-temperature curves for the aluminum-bearing steels A1 and A2 are shown in FIGS. 2(*a*) and 2(*b*), respectively. The pretreated/annealed specimens of the low-sulfur steel (A1) exhibit gradual increases in toughness with test temperature, but the toughness of the remaining material conditions is relatively insensitive to temperature. The application of a solution pretreatment and subcritical anneal prior to austenitization at 900° C. provides improvements in the toughness of the low-sulfur steel ranging from ~25% to ~50% with increases in test temperature from −60° C. to 150° C., respectively. Although a substantial amount of variability exists in the data for the high-sulfur steel (A2), the difference in the trend lines corresponds to a 15–20% improvement in the toughness of the pretreated/annealed specimens at temperatures above −20° C.

Figure 3:
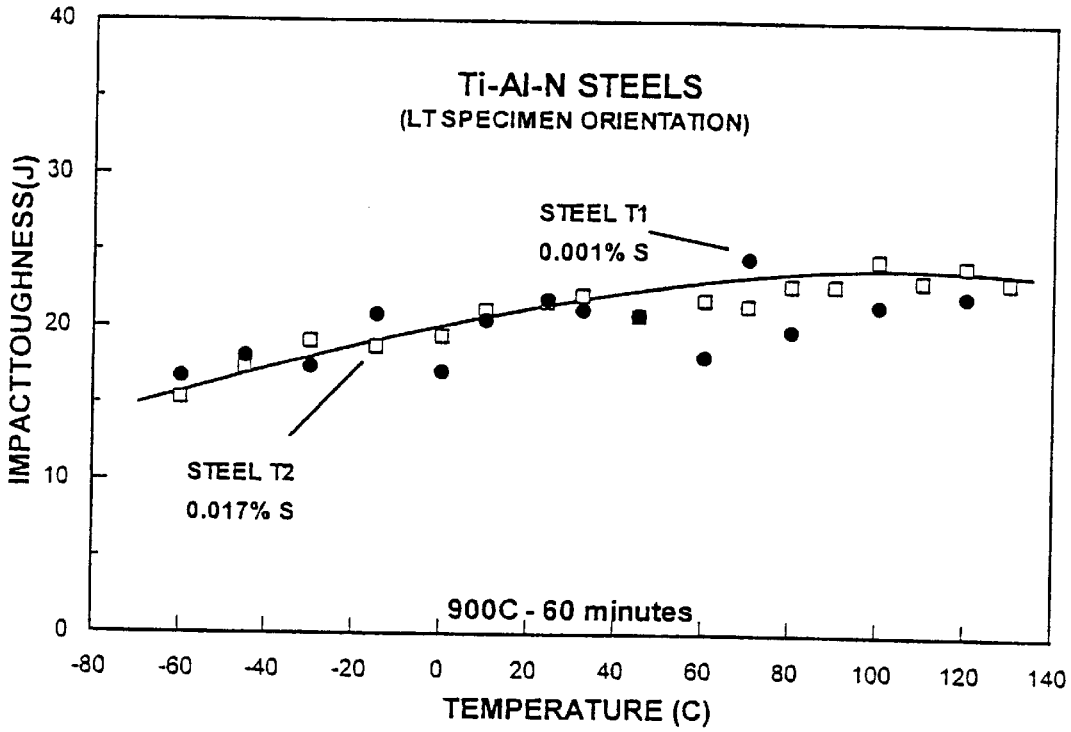
FIG. 3 is a graph showing the variation in longitudinal impact toughness with test temperature for 0.32% C—Cr—Mn steels (steels T1 and T2) containing a bimodal size distribution of TiN precipitates characteristic of the utilization of titanium as a gettering agent for nitrogen.

Impact transition-temperature curves for the titanium-bearing steels T1 and T2 are shown in FIG. 3. The impact toughness of both steels is relatively insensitive to test temperature over the −60° C. to 130° C. range, and the longitudinal toughness is independent of sulfur content over the 0.001–0.017% range. In comparing the toughness of the two steel types, the steels containing coarse dispersions of AIN exhibit the lowest levels of toughness, whereas the steels containing TiN or refined dispersions of AIN exhibit similar levels of impact toughness over a broad range of test temperature.

Steels Without Grain-Refining Precipitates

Figure 4A:
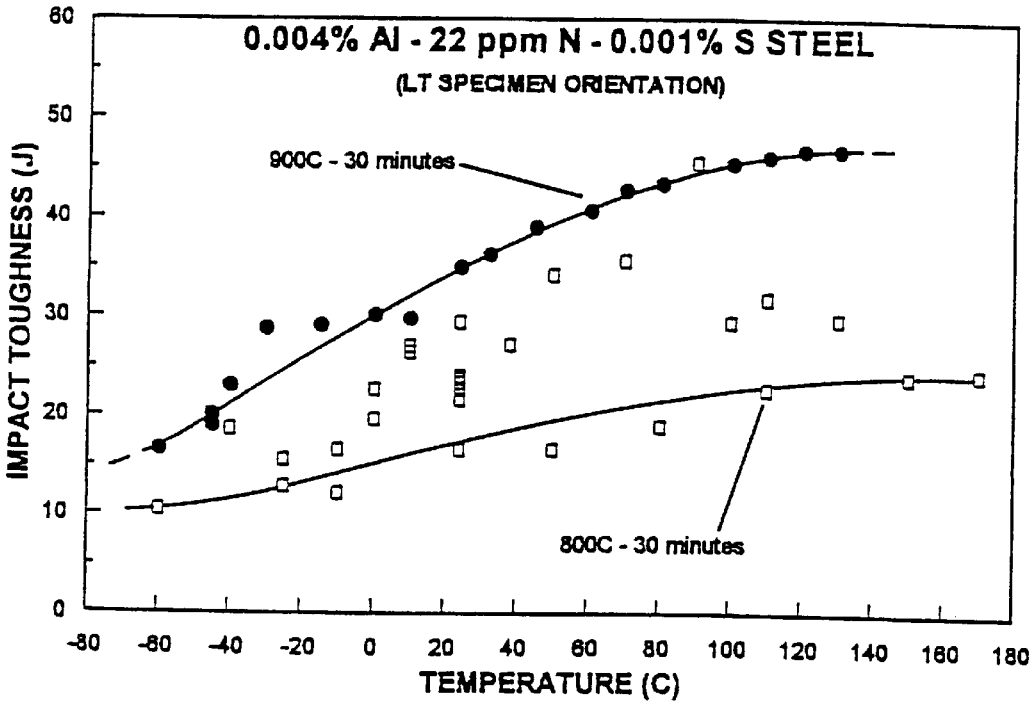
FIGS. 4(*a*) and 4(*b*) are graphs showing the variation in longitudinal impact toughness with test temperature for 0.32% C—Cr—Mn steels austenitized at 800° C. for 30 minutes and 900° C. for 30 minutes.
Figure 4B:
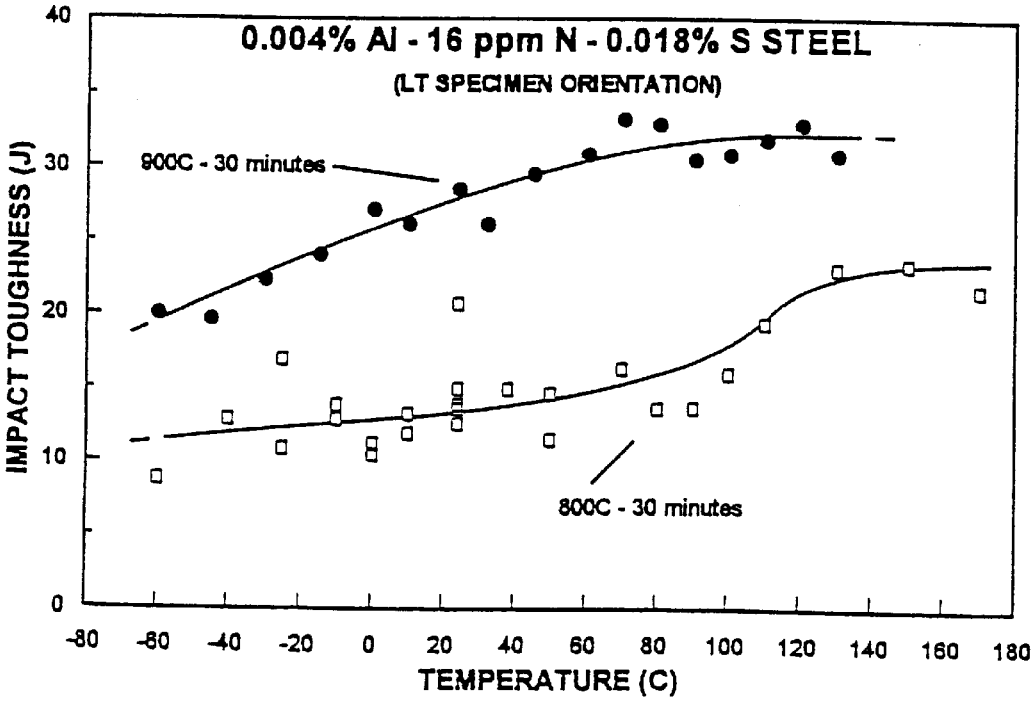

Impact transition-temperature curves for the grain-refining, precipitate-free steels N1 and N2 are shown in FIGS. 4(*a*) and 4(*b*), respectively. Both steels exhibit comparatively poor lower-bound levels of toughness over the entire range of test temperature after austenitization at 800° C. for 30 minutes, and a relatively large amount of variability in toughness exists at intermediate test temperatures, particularly for the low-sulfur steel (N1). After austenitization at 900° C. for 30 minutes, the variability in toughness is minimized and both steels (N1 and N2) exhibit substantial increases in toughness over the −60° C. to 120° C. range of test temperature.

Figure 5A:
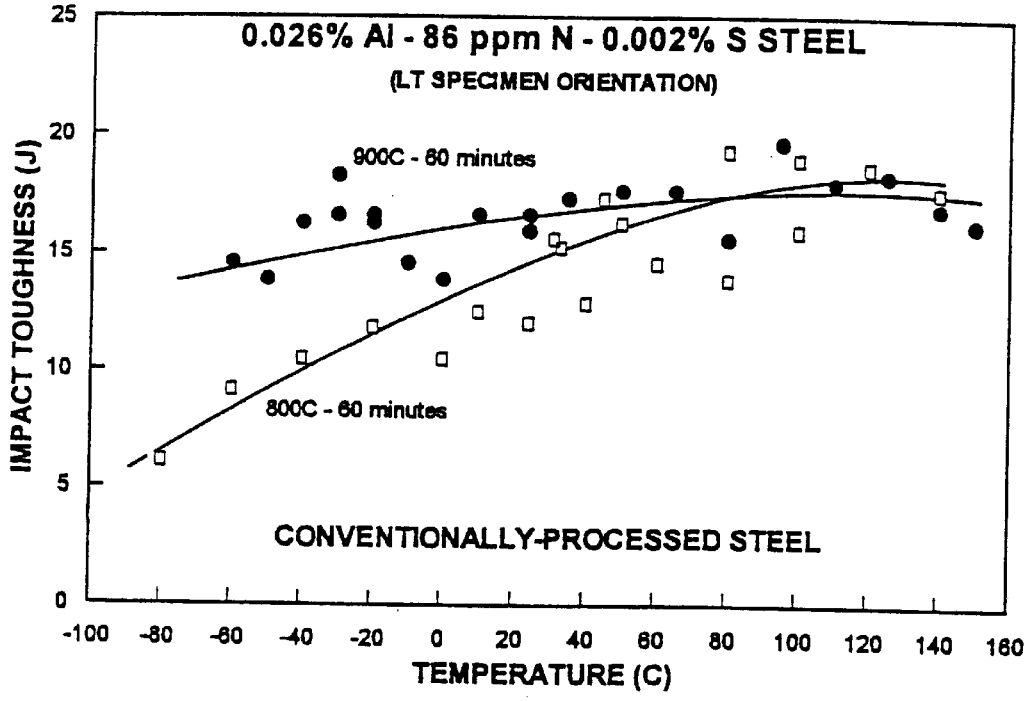
FIGS. 5(*a*)–5(*d*) are graphs comparing the toughness of 0.32% C—Cr—Mn steels containing in FIGS. 5(*a*) and 5(*c*) coarse dispersions and in FIGS. 5(*b*) and 5(*d*) fine dispersions of AIN after final austenitization at temperatures of 800° C. and 900° C.
Figure 5B:
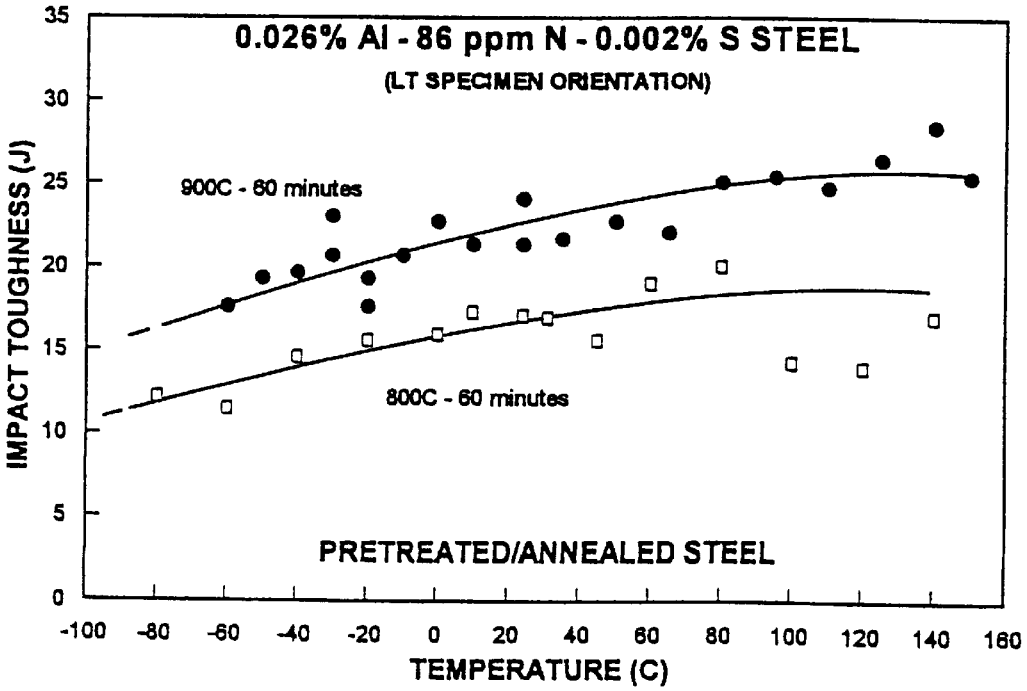
Figure 5C:
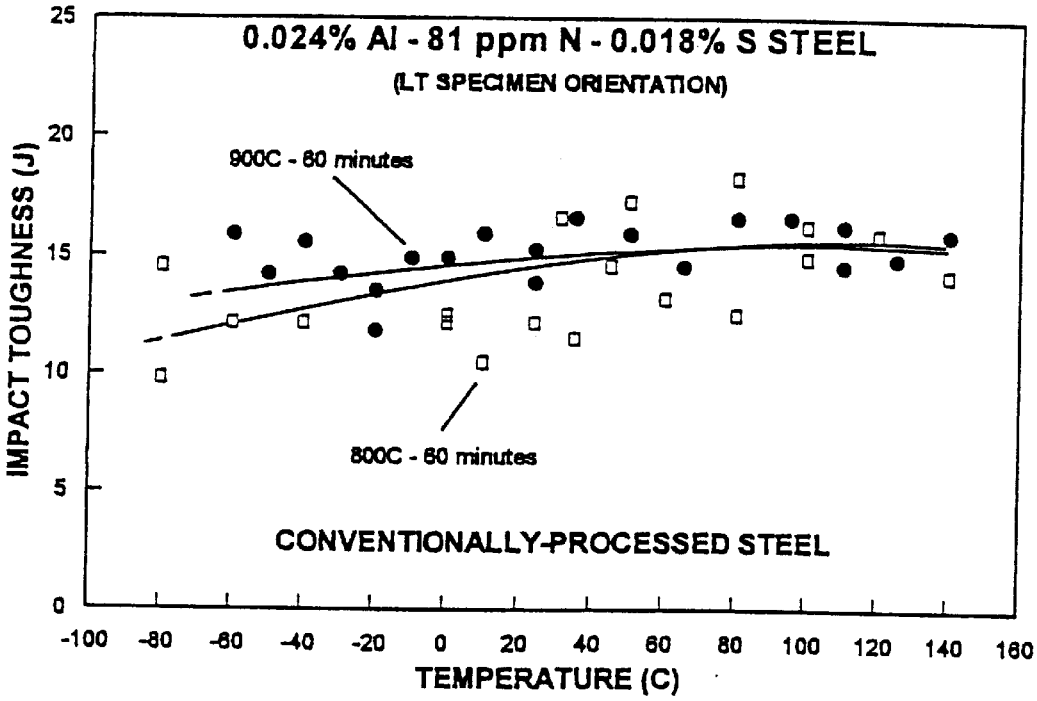
Figure 5D:
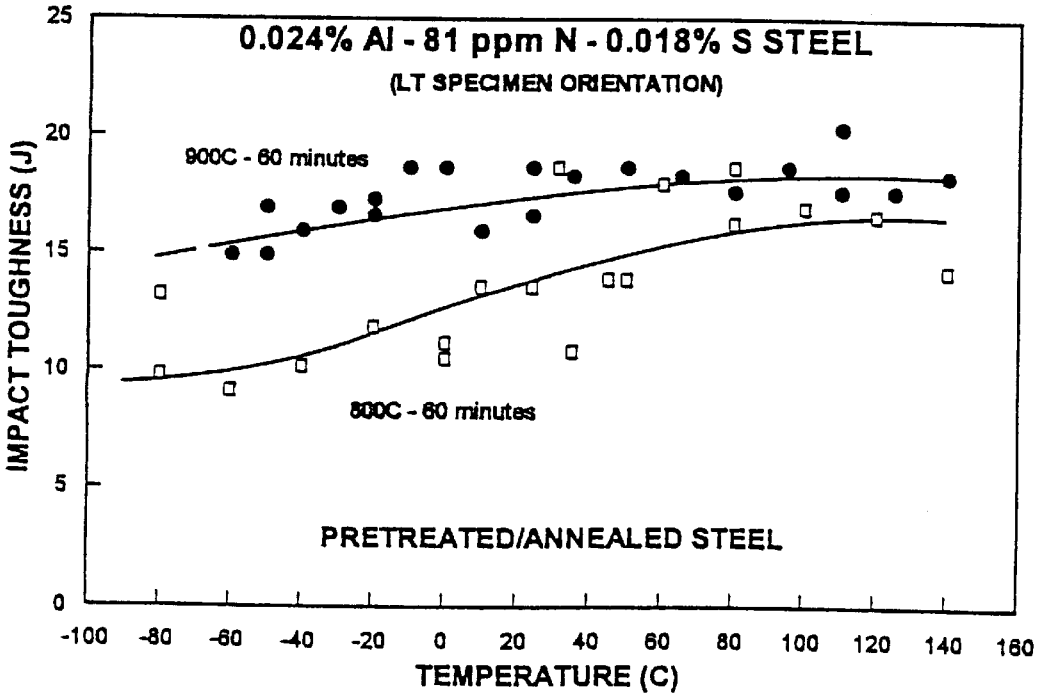

Relative Effects of Grain-Refining Precipitates and Residual Iron/Alloy Carbides Unlike the refinement-based toughening in steels A1 and A2, where the processing-induced improvements in toughness are associated with relatively small increases in the mean values of tensile reduction in area, increases in the toughness of steels N1 and N2, which result from a 100° C. increase in austenitization temperature, are accompanied by large increases in tensile ductility, Table 4. It will be noted from Table 4 that steel N1 exhibited a significant increase in ductility from 28.7% to 47.2% at the higher austenitization temperature and steel N2 had a number increase from 22.3% to 41.2%. This difference in behavior suggests that tensile fracture in lightly-tempered martensitic microstructures is significantly affected by the content of iron/alloy carbides when grain-refining precipitates are eliminated from the microstructure, FIG. 4. Conversely, the tensile fracture of lightly-tempered martensite is not critically dependent on the content and dispersion of residual iron/alloy carbides in steels containing grain-refining precipitates. This latter point is exemplified by data obtained from steels A1 and A2, where the impact toughness of conventionally-processed specimens austenitized at 800° C. and 900° C. is similar in magnitude over a broad range of test temperature for the high-sulfur steel, FIG. 5*c*, and at upper-shelf temperatures for the low-sulfur steel, FIG. 5*a*. Moreover, impact toughness is not critically dependent on the content and dispersion of residual carbides in steels containing refined AIN precipitates, but in this case a sufficient reduction in AIN content with an increase in austenitization temperature will improve toughness, FIGS. 5*b* and 5*d*. The primary difference in the behavior of steels with fine and coarse dispersions of grain-refining precipitates is that a reduction in precipitate volume fraction, produced by an increase in austenitization temperature, will preferentially dissolve smaller particles in an initially coarse dispersion, thereby retaining a large fraction of the initial dispersion that affects fracture behavior (i.e., the coarsest precipitates in the dispersion). A similar amount of precipitate dissolution, produced by an equivalent increase in austenitization temperature, effectively reduces the content of precipitates affecting fracture in a steel with a substantially refined dispersion, which in turn improves toughness. These data indicate that the optimization of toughness in lightly-tempered martensitic microstructures requires (i) the minimization of AIN content through control over steel chemistry and (ii) substantial reductions in the content of residual iron/alloy carbides through control over the hardening temperature.

TABLE 4

Summary of Tensile Test Data for Steels N1 and N2

| Steel | Material Condition[1] | Austenitization Temperature (° C.) | Austenitization Time (hours) | Yield Strength (MPa) | Tensile Strength (MPa) | Elongation in 38 mm (%) | Reduction In Area (%) |
|---|---|---|---|---|---|---|---|
| N1 | CP | 800 | 0.5 | 1410 | 1780 | 9.0 | 28.7 |
| N1 | CP | 900 | 0.5 | 1400 | 1780 | 12.7 | 47.2 |
| N2 | CP | 800 | 0.5 | 1400 | 1760 | 7.3 | 22.3 |
| N2 | CP | 900 | 0.5 | 1400 | 1740 | 11.2 | 41.2 |

[1]CP = conventional processing.

Figure 6A:
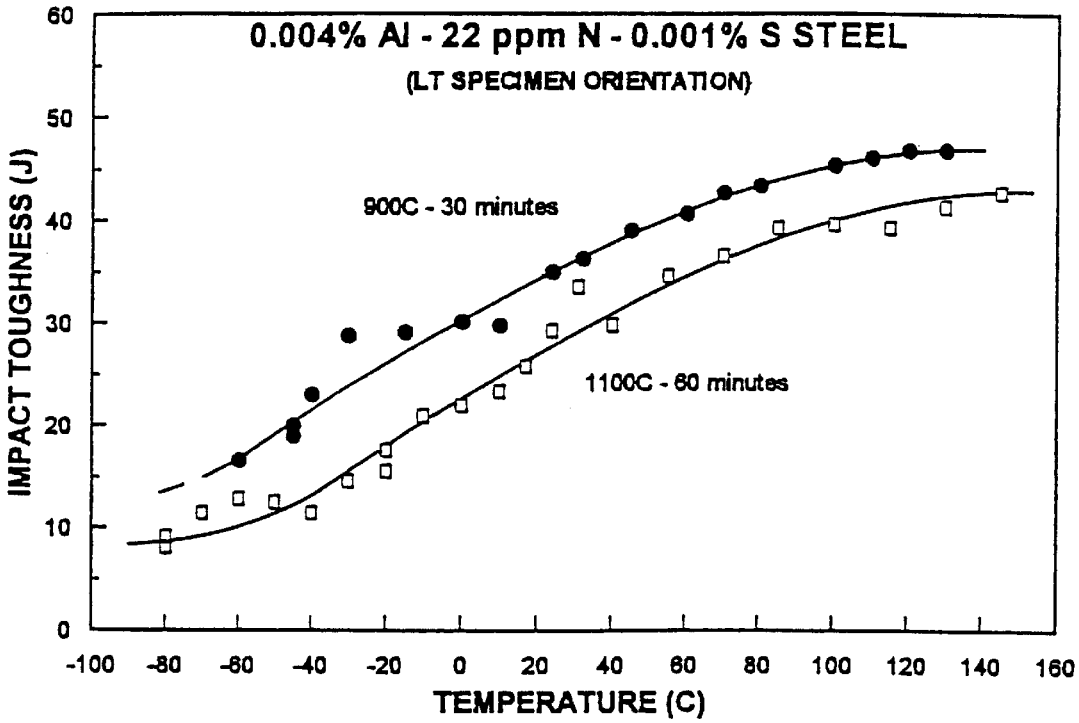
FIGS. 6(*a*) and 6(*b*) are graphs comparing the toughness of the "precipitate-free" steels after austenitization at 900° C. and 1100° C.
Figure 6B:
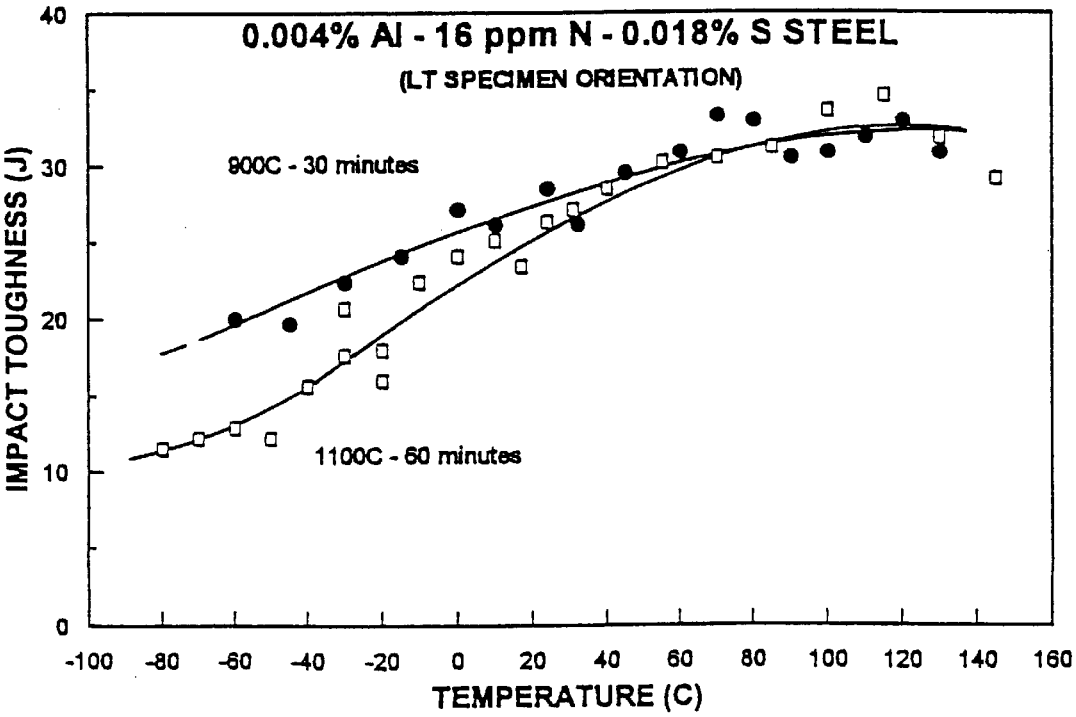

The combined elimination of grain-refining precipitates and reduction in the content of residual iron/alloy carbides allows grain growth to occur unimpeded during austenitization in steels of the present invention. However, if austenitization is conducted at moderate temperatures (e.g., ≧900° C.) for limited amounts of time (e.g., induction heating and hardening), grain size control can be maintained to some degree, thereby providing improvements in both upper-shelf and low-temperature toughness, as evidenced in FIGS. 4(*a*) and 4(*b*). Since the ductile fracture resistance of tempered martensite is somewhat insensitive to grain size for the case of transgranular fracture, the development of coarse-grained structures basically devoid of remnant second-phase particles only has a significant effect on the low-temperature impact toughness of high-strength steels. This effect is illustrated in FIG. 6 for specimens of steels N1 and N2 austenitized at 900° C. and 1100° C. In this case, the fine-grained and coarse-grained specimens exhibit similar levels of transition and upper-shelf toughness, but the coarse-grained structures exhibit inferior impact toughness at low test temperatures.

Figure 7A:
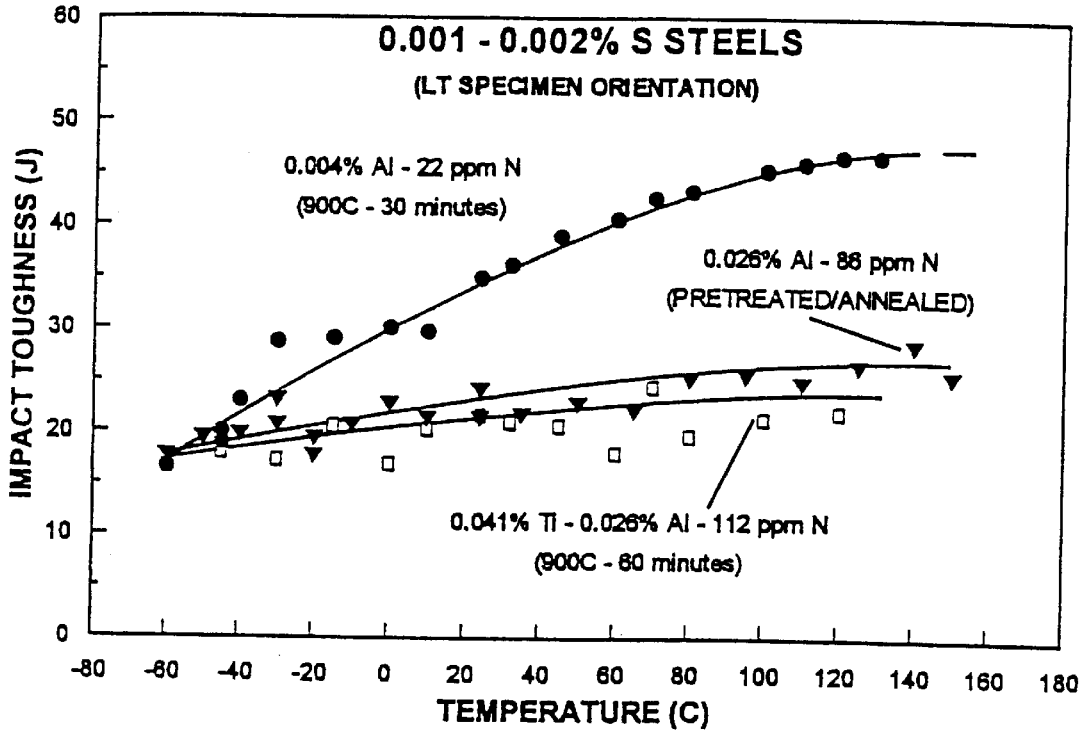
FIGS. 7(*a*) and 7(*b*) are graphs comparing the toughness of 0.32% C—Cr—Mn steels containing refined AIN precipitates (steels A1 and A2), TiN precipitates (steels T1 and T2), and a minimum content of residual iron/alloy carbides (steels N1 and N2)
Figure 7B:
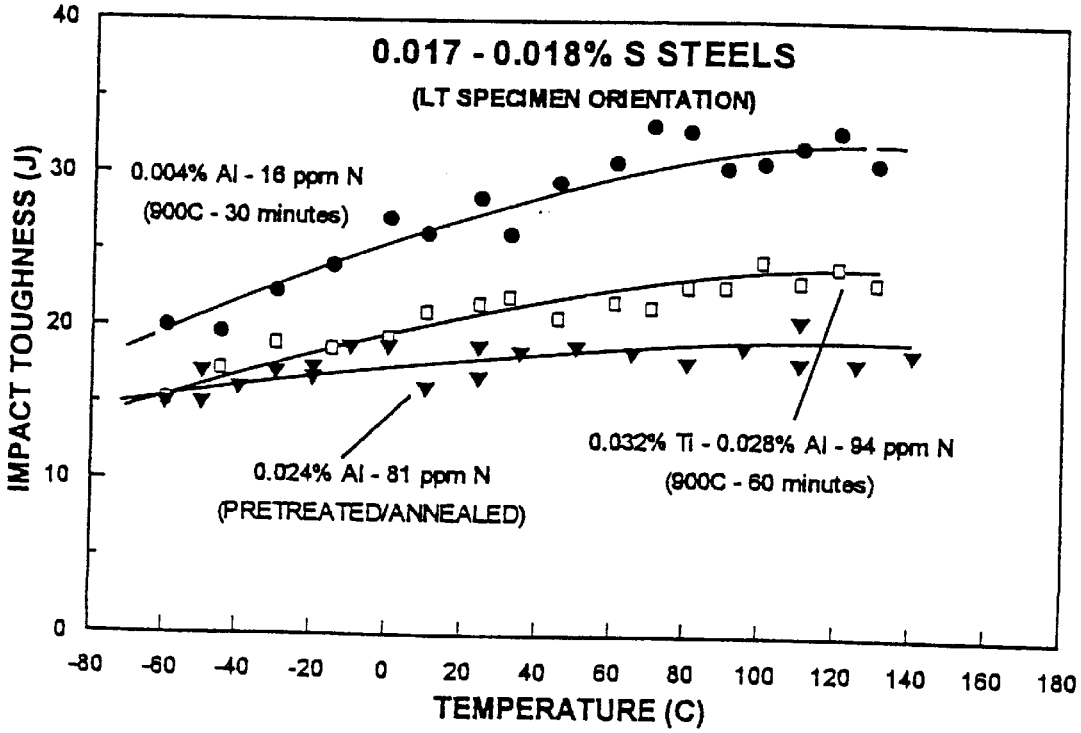

A comparison of the mechanical property data for the three types of steel, Tables 3–4 and FIG. 7, suggest that the development of optimum levels of toughness results from the virtual elimination of grain-refining precipitates and control over the residual iron/alloy carbide content in lightly-tempered martensitic microstructures, particularly at temperatures in the transition-temperature and upper-shelf regimes of fracture behavior.

While several embodiments have been shown and described, it should be recognized that other variations and/or modifications not described herein are possible without departing from the spirit and scope of the present invention.

We claim:

1. A high-strength steel possessing improved toughness, having a composition free of grain-refining elements in residual amounts of no more than about 0.005% by weight per element, said steel having been austenitized at a temperature of about 900° C. to maintain a fine grain structure, subsequently quenched and tempered to provide a lightly-tempered martensitic microstructure that is substantially free of grain-refining precipitates.

2. A high-strength steel according to claim 1 made in an air-melt, electric arc furnace and containing 80–120 ppm nitrogen and a residual level of aluminum of no greater than about 0.005% by weight.

3. A high-strength steel according to claim 1 made in a basic oxygen furnace and containing 30–70 ppm nitrogen and aluminum between 0.008% and 0.016% by weight.

4. The high-strength steel of claim 1 where tempering is conducted at a temperature of about 180° C.

5. A high-strength steel according to claim 1 made by one of a vacuum melting or air-melt/AOD process and containing about 20 ppm nitrogen and aluminum of no more than 0.024% by weight.

6. A high-strength 0.32% C—Cr—Mn steel possessing improved toughness made by vacuum induction melting and being substantially free of titanium or other grain-refining precipitate forming elements in residual amounts of no more than about 0.005% by weight per element and containing about 16–22 ppm nitrogen and 0.024% by weight maximum aluminum, said steel having been austenitized at a temperature greater than about 900° C., subsequently quenched and tempered at about 180° C. to provide a lightly-tempered martensitic microstructure.

7. A method of making a high-strength steel possessing improved toughness, comprising the steps of:

a. providing a steel composition free of grain-refining elements in residual amounts of no more than about 0.005% by weight per element;

b. austenitizing said steel at a temperature of about 900° C. to maintain a fine grain structure;

c. quenching the steel; and d. tempering the steel at a temperature of about 180° C. to provide a lightly-tempered martensitic microstructure substantially free of grain-refining precipitates.

8. The method of claim 7 wherein the steel is made in an air-melt, electric arc furnace and contains 80–120 ppm nitrogen and a residual level of aluminum of no greater than about 0.005% by weight.

9. The method of claim 7 wherein the steel is made in a basic oxygen furnace and contains 30–70 ppm nitrogen and aluminum between 0.008% and 0.016% by weight.

10. The method of claim 7 wherein the steel is made by one of a vacuum melting or air-melt/AOD process and contains about 20 ppm nitrogen and aluminum of no more than 0.024% by weight.

11. A method of making a high-strength steel possessing improved toughness, comprising the steps of:

a. providing a 0.32% C—Cr—Mn steel by vacuum induction melting, said steel being substantially free of titanium and other grain-refining precipitate forming elements in residual amounts of no more than about 0.005% by weight per element and containing about 16–22 ppm nitrogen and 0.024% by weight maximum aluminum;

b. austenitizing said steel at a temperature greater than about 900° C.;

c. quenching the steel; and d. tempering the steel at a temperature of about 180° C. to provide a lightly-tempered martensitic microstructure.

12. A method of making a high-strength steel possessing improved toughness, comprising the steps of:

a. vacuum induction melting a steel alloy consisting essentially of, in % by weight, about 0.30–0.35 C, 0.7–0.8 Mn, 0.20–0.25 Si, 0.5 Cr, 0.10–0.15 Ni, 0.05 Mo, less than 0.02 S, less than 0.01 P, up to about 0.02 Al and up to about 0.002 N;

b. austenitizing said steel at a temperature greater than about 900° C.;

c. quenching the steel; and d. tempering the steel at a temperature of about 180° C. to provide a lightly-tempered martensitic microstructure.

13. The method of claim 12 wherein the steel alloy contains less than about 0.002% S and less than about 0.008% Al.

* * * * *

UNITED STATES PATENT AND TRADEMARK OFFICE

CERTIFICATE OF CORRECTION

PATENT NO. : 6,277,216 B1
DATED : August 21, 2001
INVENTOR(S) : Michael J. Leap et al.

It is certified that error appears in the above-identified patent and that said Letters Patent is hereby corrected as shown below:

Title page,
Item [56] References Cited, OTHER PUBLICATIONS,
Reference 2, "AdvanTec'198" should read -- AdvanTec™ --.

Column 1,
Line 67, "AIN" should read -- A1N --.

Column 3,
Line 26, "AIN:" should read -- A1N --.
Line 43, "AIN" should read -- A1N --.
Line 53, "AIN" should read -- A1N --.

Column 4,
Line 1, "hereinafter" should read -- (hereinafter --.
Line 17, "AIN" should read -- A1N --.
Line 36, "008%" should read -- 0.008% --.
Line 46, "AIN" should read -- A1N --.

Column 5,
Line 29, "coarse AIN" should read -- coarse A1N --.
Line 29, "refined AIN" should read -- refined A1N --.

Column 6,
Line 22, "AIN" should read -- A1N --.
Line 64 "AIN" should read -- A1N --.

Column 7,
Line 49, "AIN" should read -- A1N --.
Line 50, "AIN" should read -- A1N --.

UNITED STATES PATENT AND TRADEMARK OFFICE

CERTIFICATE OF CORRECTION

PATENT NO. : 6,277,216 B1
DATED : August 21, 2001
INVENTOR(S) : Michael J. Leap et al.

It is certified that error appears in the above-identified patent and that said Letters Patent is hereby corrected as shown below:

Column 8,
Line 45, "AIN" should read -- A1N --.
Line 46, "AIN" should read -- A1N --.
Line 64, "AIN" should read -- A1N --.

Signed and Sealed this

Twelfth Day of March, 2002

*Attest:*

*Attesting Officer*

JAMES E. ROGAN
*Director of the United States Patent and Trademark Office*